US005213697A

United States Patent [19]

Vinci et al.

[11] Patent Number: 5,213,697

[45] Date of Patent: May 25, 1993

[54] METHOD FOR REDUCING FRICTION BETWEEN RAILROAD WHEEL AND RAILWAY TRACK USING METAL OVERBASED COLLOIDAL DISPERSE SYSTEMS

[75] Inventors: James N. Vinci, Mayfield Hts.; Robert E. Quinn, Cleveland, both of Ohio

[73] Assignee: The Lubrizol Corporation, Wickliffe, Ohio

[21] Appl. No.: 872,223

[22] Filed: Apr. 22, 1992

Related U.S. Application Data

[63] Continuation of Ser. No. 340,903, Apr. 20, 1989, abandoned.

[51] Int. Cl.[5] ..... C10M 113/00; C10M 125/10

[52] U.S. Cl. ..... 252/18; 252/25; 252/33; 252/38; 252/39; 252/41

[58] Field of Search ..... 252/18, 25, 33, 38, 252/39, 41

[56] References Cited

U.S. PATENT DOCUMENTS

| | | | |
|---|---|---|---|
| 3,216,936 | 11/1965 | Le Suer | 252/32.7 |
| 3,219,666 | 11/1965 | Norman et al. | 260/268 |
| 3,252,908 | 5/1966 | Coleman | 252/31 |
| 3,255,108 | 6/1966 | Wiese | 252/32.7 |
| 3,269,946 | 8/1966 | Wiese | 252/32.5 |
| 3,492,231 | 1/1970 | McMillen | 252/33 |
| 3,502,677 | 3/1970 | Le Suer | 260/268 |
| 3,708,522 | 1/1973 | Le Suer | 260/485 |
| 3,714,042 | 1/1973 | Greenough | 252/33.2 |
| 4,185,485 | 1/1980 | Schick et al. | 72/42 |
| 4,230,586 | 10/1980 | Bretz et al. | 252/8.5 |
| 4,321,153 | 3/1982 | Recchuite | 252/48.6 |
| 4,468,339 | 8/1984 | Rysek et al. | 252/75 |
| 4,505,830 | 3/1985 | Vinci | 252/33 |
| 4,634,545 | 6/1987 | Zaleski et al. | 252/29 |
| 4,752,416 | 6/1988 | Scharf et al. | 252/78.5 |
| 4,811,818 | 3/1989 | Jamison | 184/3.2 |
| 4,832,857 | 5/1989 | Hunt et al. | 252/33 |
| 4,867,891 | 9/1989 | Hunt | 252/33 |

FOREIGN PATENT DOCUMENTS

| | | |
|---|---|---|
| WO8706256 | 10/1987 | PCT Int'l Appl. . |
| 1187822 | 4/1970 | United Kingdom . |

*Primary Examiner*—Jerry Johnson

*Attorney, Agent, or Firm*—Forrest L. Collins; Frederick D. Hunter; David M. Shold

[57] ABSTRACT

A method for reducing friction between railroad wheel and railway track is disclosed comprising applying to the railway track a composition comprising an overbased non-Newtonian colloidal disperse system comprising: (1) solid metal-containing colloidal particles predispersed in (2) a disperse medium of at least one inert organic liquid and (3) at least one member selected from the class consisting of organic compounds which are substantially soluble in the disperse medium, the molecules of said organic compound being characterized by polar substituents and hydrophobic portions.

37 Claims, No Drawings

METHOD FOR REDUCING FRICTION BETWEEN RAILROAD WHEEL AND RAILWAY TRACK USING METAL OVERBASED COLLOIDAL DISPERSE SYSTEMS

This is a continuation of copending application Ser. No. 07/340,903 filed on Apr. 20, 1989 now abandoned.

FIELD OF THE INVENTION

This invention relates to a method for reducing friction between railroad wheel and railway track comprising applying to the railway track a friction-reducing and wear-reducing composition. The composition comprises a metal overbased non-Newtonian colloidal disperse system comprising solid metal-containing colloidal particles predispersed in a disperse medium of at least one inert organic liquid and at least one member selected from the class consisting of organic compounds which are substantially soluble in the disperse medium, the molecules of said organic compound being characterized by polar substituents and hydrophobic portions.

BACKGROUND OF THE INVENTION

Railroads have lubricated curved rail with trackside (wayside) lubricators to reduce friction between the flanges of the railroad car wheels and the rail. A pump in the wayside applicator is mechanically activated as a train passes and a stream of grease is applied to the gage face (a face engaging the wheel flange that is not the top running surface) of the rail.

Recently, railroads have discovered that the application of grease on straight rail (tangent track), can provide substantial benefits, such as up to 30% fuel savings, reduced wheel and rail replacements, and reduced derailments. Wayside applicators are now being supplemented by locomotive mounted applicators, hyrail applicators, and portable units mounted on trucks which run along the track and apply grease to the gage face of the rails. This has caused a substantial increase in the demand for rail lubricants.

Rail lubricants typically comprise molybdenum sulfide-, graphite-, and lead-containing soap-based or solids-containing greases. These rail lubricants are deficient for large scale use since lead and molybdenum sulfide are undesirable from an environmental and/or toxicological viewpoint, and graphite is opaque and messy, which makes maintenance of the applicators difficult, and is not very effective by itself in reducing friction.

The applicants have discovered that a non-Newtonian metal overbased colloidal disperse system is capable of achieving the desired economical reduction in friction between railroad wheel and rail, along with extreme pressure/anti-wear protection, without posing the environmental, toxicological and cleanliness problems of the prior art rail lubricants.

The terms "overbased", "superbased", and "hyperbased", are terms of art which are generic to well known classes of metal-containing materials which for the last several decades have been employed as detergents and/or dispersants in lubricating oil compositions. These over-based materials, which have also been referred to as "complexes", "metal complexes", "high-metal containing salts", and the like, are characterized by a metal content in excess of that which would be present according to the stoichiometry of the metal and the particular organic compound reacted with the metal, e.g., a carboxylic or sulfonic acid.

Newtonian overbased materials and non-Newtonian colloidal disperse systems comprising solid metal-containing colloidal particles predispersed in a disperse medium of at least one inert organic liquid and a third component selected from the class consisting of organic compounds which are substantially insoluble in said disperse medium are known. See, for example, U.S. Pat. Nos. 3,492,231; 4,230,586; and 4,468,339.

Carboxylic acid derivatives made from high molecular weight carboxylic acid acylating agents and amino compounds and their use in oil-based lubricants are well known. See, for example, U.S. Pat. Nos. 3,216,936; 3,219,666; 3,502,677; and 3,708,522.

Certain alkyl succinic acid/alkanol amine condensates have also been described; see, for example, U.S. Pat. No. 3,269,946. Water-in-oil emulsions containing alkyl and alkenyl succinic acid derivatives are also known; see, for example, U.S. Pat. Nos. 3,255,108; 3,252,908 and 4,185,485.

Surfactants are also well known. See, for example, the text entitled "Non-ionic Surfactants" edited by M. J. Schick, published by Marcel Dekker, Inc., New York, 1967 and McCutcheon's "Detergents and Emulsifiers", 1978, North American Edition, published by McCutcheon's Division, MC Publishing Corporation, Glen Rock, N.J., U.S.A.

Oil-soluble, water-insoluble functional additives are also well known. See, for example, the treatises by C. B. Smalheer and R. Kennedy Smith, published by Lezius-Hiles Co., Cleveland, Ohio, 1967, and by M. W. Ranney, published by Noyes Data Corp., Parkridge, N.J., 1973 entitled "Lubricant Additives". In this connection, and throughout the specification and appended claims, a water-insoluble functional additive is one which is not soluble in water above a level of about 1 gram per 100 milliliters of water at 25° but is soluble in mineral oil to the extent of at least one gram per liter at 25°.

SUMMARY OF THE INVENTION

The present invention comprises a method for reducing friction between railroad wheel and railway track comprising applying to the railway track a composition comprising an overbased non-Newtonian colloidal disperse system comprising (1) solid metal-containing colloidal particles predispersed in (2) a disperse medium of at least one inert organic liquid and (3) at least one member selected from the class consisting of organic compounds which are substantially soluble in the disperse medium, the molecules of said organic compound being characterized by polar substituents and hydrophobic portions.

These compositions may further comprise a lubricating oil or grease, a Newtonian overbased material, and/or an auxiliary extreme pressure agent, among other functional materials.

The inventors have discovered that the application of the over-based compositions to railway track reduces friction between railroad wheel and railway track and provides the anti-wear properties of an extreme pressure agent without the need for adding any auxiliary friction modifier and/or extreme pressure agent. The properties of the compositions used in the present invention can, however, be further improved by further adding one or more functional additives to the overall composition.

The present invention further comprises the above-described rail lubricants, particularly those which do not contain property modifying amounts of functional additives other than the non-Newtonian, and optionally Newtonian, metal overbased materials described above.

The present invention further encompasses rail lubricating systems comprising a rail lubricant applicator containing a lubricant composition comprising the above-described overbased non-Newtonian colloidal disperse system.

DETAILED DESCRIPTION OF THE PREFERRED EMBODIMENT

The Overbased Material:

As indicated above, the terms "overbased," "superbased," and "hyperbased," are terms of art which are generic to well known classes of metal-containing materials which have generally been employed as detergents and/or disperants in lubricating oil compositions. These over-based materials have also been referred to as "complexes," "metal complexes," "high-metal containing salts," and the like. Overbased materials are characterized by a metal content in excess of that which would be present according to the stoichiometry of the metal and the particular organic compound reacted with the metal, e.g., a carboxylic or sulfonic acid. Thus, if a monocarboxylic acid,

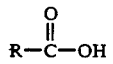

is neutralized with a basic metal compound, e.g., calcium hydroxide, the "normal" metal salt produced will contain one equivalent of calcium for each equivalent of acid, i.e.,

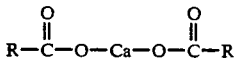

However, as is well known in the art, various processes are available which result in an inert organic liquid solution of a product containing more than the stoichiometric amount of metal. The solutions of these products are referred to herein as overbased materials. Following these procedures, the carboxylic acid or an alkali or alkaline earth metal salt thereof can be reacted with a metal base and the product will contain an amount of metal in excess of that necessary to neutralize the acid, for example, 4.5 times as much metal as present in the normal salt or a metal excess of 3.5 equivalents.

The actual stoichiometric excess of metal can vary considerably, for example, from about 0.1 equivalent to about 50 or more equivalents depending on the reactions, the process conditions, and the like. The overbased materials useful in accordance with the present invention contain from about 1.1 to about 40 or more equivalents of metal for each equivalent of material which is overbased.

In the present specification and claims the term "overbased" is used to designate materials containing a stoichiometric excess of metal and is, therefore, inclusive of those metals which have been referred to in the art as overbased, superbased, hyperbased, etc., as discussed supra.

The terminology "metal ratio" is used in the prior art and herein to designate the ratio of the total chemical equivalents of the metal in the overbased material (e.g., a metal sulfonate or carboxylate) to the chemical equivalents of the metal in the product which would be expected to result in the reaction between the organic material to be overbased (e.g., sulfonic or carboxylic acid) and the metal-containing reactant (e.g., calcium hydroxide, barium oxide, etc.) according to the known chemical reactivity and stoichiometry of the two reactants. Thus, in the normal calcium carbonate discussed above, the metal ratio is one, and in the overbased carbonate, the metal ratio may be 4.5. Obviously, if there is present in the material to be overbased more than one compound capable of reacting with the metal, the "metal ratio" of the product will depend upon whether the number of equivalents of metal in the overbased product is compared to the number of equivalents expected to be present for a given single component or a combination of all such components.

Generally, overbased materials are prepared by treating a reaction mixture comprising the organic material to be overbased, a reaction medium consisting essentially of at least one inert, organic solvent for said organic material, a stoichiometric excess of a metal base, and a promoter with an acidic material. The methods for preparing the overbased materials for use in the present invention, as well as an extremely diverse group of overbased materials, are well known in the prior art and are disclosed for example in the following U.S. Pat. Nos. 2,616,904; 2,616,905; 2,616,906, 2,616,911; 2,616,924; 2,616,925; 2,617,049; 2,695,910; 2,723,234; 2,723,235; 2,723,236; 2,760,970; 2,767,164; 2,767,209; 2,777,874; 2,798,852; 2,839,470; 2,856,359; 2,859,360; 2,856,361; 2,861,951; 2,883,340; 2,915,517; 2,959,551; 2,968,642; 2,971,014; 2,989,463; 3,001,981; 3,027,325; 3,070,581; 3,108,960; 3,147,232; 3,133,019; 3,146,201; 3,152,991; 3,155,616; 3,170,880; 3,170,881; 3,172,855; 3,194,823; 3,223,630; 3,232,883; 3,242,079; 3,242,080; 3,250,710; 3,256,186; 3,274,135; 3,492,231; and 4,230,586. These patents disclose processes, materials which can be overbased, suitable metal bases, promoters, and acidic materials, as well as a variety of specific overbased products useful in producing the disperse systems for use in this invention and are, accordingly, incorporated herein by reference.

An important characteristic of the organic materials which are overbased is their solubility in the particular reaction medium utilized in the overbasing process. As the reaction medium used previously has normally comprised petroleum fractions, particularly mineral oils, these organic materials have generally been oil-soluble. However, if another reaction medium is employed (e.g. aromatic hydrocarbons, aliphatic hydrocarbons, kerosene, etc.) it is not essential that the organic material be soluble in mineral oil as long as it is soluble in the given reaction medium. Obviously, many organic materials which are soluble in mineral oils will be soluble in many of the other indicated suitable reaction mediums. It should be apparent that the reaction medium usually becomes the disperse medium of the colloidal disperse system or at least a component thereof depending on whether or not additional inert organic liquid is added as part of the reaction medium or the disperse medium.

Materials which can be overbased are generally oil-soluble organic acids including phosphorus acids, thiophosphorus acids, sulfur acids, carboxylic acids, thiocarboxylic acids, and the like, as well as the corresponding alkali and alkaline earth metal salts thereof. Representative examples of each of these classes of organic acids, as well as other organic acids, e.g., nitrogen acids, arsenic acids, etc., are disclosed along with methods of preparing overbased products therefrom in the above cited patent and are, accordingly, incorporated herein by reference. U.S. Pat. No. 2,777,874 identifies organic acids suitable for preparing overbased materials which can be converted to disperse systems for use in the resinous compositions of the invention. Similarly, U.S. Pat. Nos. 2,616,904; 2,695,910; 2,767,164; 2,767,209; 3,147,232; 3,274,135; etc., disclose a variety of organic acids suitable for preparing overbased materials as well as representative examples of overbased products prepared from such acids. Overbased acids wherein the acid is a phorphorus acid, a thiophosphorus acid, phosphorus acid-sulfur acid combination, and sulfur acid prepared from polyolefins are disclosed in U.S. Pat. Nos. 2,883,340; 2,915,517; 3,001,981; 3,108,960; and 3,232,883. Overbased phenates are disclosed in U.S. Pat. No. 2,959,551, while overbased ketones are found in U.S. Pat. No. 2,798,852. A variety of overbased materials derived from oil-soluble metal-free, non-tautomeric neutral and basic organic polar compounds such as ester, amines, amides, alcohols, ethers, sulfides, sulfoxides, and the like are disclosed in U.S. Pat. Nos. 2,968,642; 2,971,014; and 2,989,463. Another class of materials which can be overbased are the oil-soluble, nitro-substituted aliphatic hydrocarbons, particularly nitro-substituted polyolefins such as polyethylene, polypropylene, polyisobutylene, etc. Materials of this type are illustrated in U.S. Pat. No. 2,959,551. Likewise, the oil-soluble reaction product of alkylene polyamines such as propylene diamine or N-alkylated propylene diamine with formaldehyde or formaldehyde producing compound (e.g., paraformaldehyde) can be overbased. Other compounds suitable for overbasing are disclosed in the above-cited patents or are otherwise well-known in the art.

The organic liquids used as the disperse medium in the colloidal disperse system can be used as solvents for the overbasing process.

The metal compounds used in preparing the overbased materials are normally the basic salts of metals in Group I-A and Group II-A of the Periodic Table, although other metals such as lead, zinc, manganese, etc., can be used in the preparation of overbased materials. The anionic portion of the salt can be hydroxyl, oxide, carbonate, hydrogen carbonate, nitrate, sulfite, hydrogen sulfite, halide, amide, sulfate, etc., as disclosed in the above-cited patents. For purposes of this invention the preferred overbased materials are prepared from the alkaline earth metal oxides, hydroxides, and alcoholates such as the alkaline earth metal lower alkoxides. The more preferred disperse systems of the invention are made from overbased materials containing calcium, magnesium, sodium, lithium, and/or barium as the metal, and, from the standpoint of environmental safety and cost, the most preferred disperse systems of the invention are made from overbased materials containing calcium and/or sodium.

The promoters, that is, the materials which permit the incorporation of the excess metal into the overbased material, are also quite diverse and well known in the art as evidenced by the cited patents. A particularly comprehensive discussion of suitable promoters is found in U.S. Pat. Nos. 2,777,874; 2,695,910; and 2,616,904. These include the alcoholic and phenolic promoters which are preferred. The alcoholic promoters include the alkanols of one to about eighteen carbon atoms, preferably one to about twelve carbon atoms, and more preferably one to about five carbon atoms, such as methanol, ethanol, n-butanol, amyl alcohol, octanol, isopropanol, isobutanol, and mixtures of these and the like. Phenolic promoters include a variety of hydroxy-substituted benzenes and naphthalenes. A particularly useful class of phenols are the alkylated phenols of the type listed in U.S. Pat. No. 2,777,874, e.g., heptylphenols, octylphenols, and nonylphenols. Mixtures of various promoters are sometimes used.

Suitable acidic materials are also disclosed in the above cited patents, for example, U.S. Pat. No. 2,616,904. Included within the known group of useful acidic materials are liquid acids such as formic acid, acetic acid, nitric acid, sulfuric acid, hydrochloric acid, hydrobromic acid, carbamic acid, substituted carbamic acids, etc. Acetic acid is a very useful acidic material, although inorganic acidic materials such as HCl, $SO_2$, $SO_3$, $CO_2$, $H_2S$, $N_2O_3$, etc., are ordinarily employed as the acidic materials. The most preferred acidic materials are carbon dioxide and acetic acid.

In preparing overbased materials, the material to be overbased, an inert, non-polar, organic solvent therefor, the metal base, the promoter and the acidic material are brought together and a chemical reaction ensues. The exact nature of the resulting overbased product is not known. However, it can be adequately described for purposes of the present specification as a single phase homogeneous mixture of the solvent and (1) either a metal complex formed from the metal base, the acidic material, and the material being overbased and/or (2) an amorphous metal salt formed from the reaction of the acidic material with the metal base and the material which is said to be overbased. Thus, if mineral oil is used as the reaction medium, carboxylic acid as the material which is overbased, $Ca(OH)_2$ as the metal base, and carbon dioxide as the acidic material, the resulting overbased material can be described for purposes of this invention as an oil solution of either a metal containing complex of the acidic material, the metal base, and the carboxylic acid or as an oil solution of amorphous calcium carbonate and calcium carboxylate.

The temperature at which the acidic material is contacted with the remainder of the reaction mass depends to a large measure upon the promoting agent used. With a phenolic promoter, the temperature usually ranges from about 80° C. to 300° C., and preferably from about 100° C. to about 200° C. When an alcohol or mercaptan is used as the promoting agent, the temperature usually will not exceed the reflux temperature of the reaction mixture and preferably will not exceed about 100° C.

In view of the foregoing, it should be apparent that the over-based materials may retain all or a portion of the promoter. That is, if the promoter is not volatile (e.g., an alkyl phenol) or otherwise readily removable from the overbased material, at least some promoter remains in the overbased product. Accordingly, the disperse systems made from such products may also contain the promoter. The presence or absence of the promoter in the overbased material used to prepare the disperse system and likewise, the presence or absence of the promoter in the colloidal disperse systems themselves does not represent a critical aspect of the invention. Obviously, it is within the skill of the art to select a volatile promoter such as a lower alkanol, e.g., methanol, ethanol, etc., so that the promoter can be readily removed prior to incorporation with the compositions of the present invention to forming the disperse system or thereafter.

The terminology "disperse system" as used in the specification and claims is a term of art generic to colloids or colloidal solutions, e.g., "any homogeneous medium containing dispersed entities of any size and state," Jirgensons and Straumanis, "A Short Textbook on Colloidal Chemistry" (2nd Ed.) The Macmillan Co., New York, 1962 at page 1. However, the particular disperse systems of the present invention form a subgenus within this broad class of disperse system, this subgenus being characterized by several important features.

This subgenus comprises those disperse systems wherein at least a portion of the particles dispersed therein are solid, metal-containing particles formed in situ. At least about 10% to about 50% are particles of this type and preferably substantially all of said solid particles are formed in situ.

So long as the solid particles remain dispersed in the dispersing medium as colloidal particles, the particle size is not critical. Ordinarily, the particles will not exceed a number average particle size of 5.0 microns. However, it is preferred that the number average particle size be less than or equal to about 2.0 microns. In a more preferred aspect of the invention, the number average particle size is less than or equal to 2.0 microns and more than 80 number percent of the solid metal-containing particles have a particle size less than 5.0 microns. In a particularly preferred aspect of the invention, the number average particle size is less than or equal to 1.0 micron and more than 80 number percent of the solid metal-containing particles have a particle size less than about 2.0 microns.

The number average particle size is the sum of the particle size of the solid metal-containing colloidal particles per unit volume divided by the number of particles in the unit volume. This average particle size determination may be made using, for example, an instrument known as a Nicomp Model 270 commercially available from Specific Scientific Co., which uses quasi elastic light scattering (i.e., QELS), a laser light scattering method for determining particle size which is well known to those of ordinary skill in the colloidal dispersion art.

Systems having a number average unit particle size of less than or equal to 2.0 microns, are preferred, and those having a number average unit particle size less than or equal to 1.0 micron is more preferred. Systems having a unit particle size in the range from 0.03 micron to 0.5 micron give excellent results. The minimum unit particle size is at least 0.02 micron and preferably at least 0.03 micron.

The language "unit particle size", as opposed to "particle size", is intended to designate the average particle size of the solid, metal-containing particles assuming maximum dispersion of the individual particles throughout the disperse medium. That is, the unit particle is that particle which corresponds in size to the average size of the metal-containing particles and is capable of independent existence within the disperse system as a discrete colloidal particle. These metal-containing particles are found in two forms in the disperse systems of the present invention. Individual unit particles can be dispersed as such throughout the medium or unit particles can form an agglomerate, in combination with other materials (e.g., another metal-containing particle, the disperse medium, etc.) which are present in the disperse systems. These agglomerates are dispersed through the system as "metal-containing particles". Obviously, the "particle size" of the agglomerate is substantially greater than the unit particle size.

Furthermore, it is equally apparent that this agglomerate size is subject to wide variations, even within the same disperse system. The agglomerate size varies, for example, with the degree of shearing action employed in dispersing the unit particles. That is, mechanical agitation of the disperse system tends to break down the agglomerates into the individual components thereof and disperse these individual components throughout the disperse medium. The ultimate in dispersion is achieved when each solid, metal-containing particle is individually dispersed in the medium.

Accordingly, the disperse systems may be characterized with reference to the unit particle size, it being apparent to those skilled in the art that the unit particle size represents the average size of solid, metal-containing particles present in the system which can exist independently. The number average particle size of the metal-containing solid particles in the system can be made to approach the unit particle size value by the application of a shearing action to the existent system or during the formation of the disperse system as the particles are being formed in situ. It is not necessary that maximum particle dispersion exist to have useful disperse systems. The agitation associated with homogenization of the overbased material and conversion agent produces sufficient particle dispersion.

Basically, the solid metal-containing particles are in the form of metal salts of inorganic acids, and low molecular weight organic acids, hydrates thereof, or mixtures of these. These salts are usually the alkali and alkaline earth metal formates, acetates, carbonates, sulfides, sulfites, sulfates, thiosulfates, and halides, among which the carbonates are preferred. In other words, the metal-containing particles are ordinarily particles of metal salts, the unit particle is the individual salt particle and the unit particle size is the average particle size of the salt particles which is readily ascertained, as for example, by conventional X-ray diffraction techniques or laser light scattering, such as the above-mentioned QELS technique. Colloidal disperse systems possessing particles of this type are sometimes referred to as macromolecular colloidal systems.

Because of the composition of the colloidal disperse systems of this invention, the metal-containing particles also exist as components in micellar colloidal particles. In addition to the solid metal-containing particles and the disperse medium, the colloidal disperse systems of the invention are characterized by a third component, one which is soluble in the medium and contains in the molecules thereof a hydrophobic portion and at least one polar substituent. This third component can orient itself along the external surfaces of the above metal salts, the polar groups lying along the surface of these salts with the hydrophobic portions extending from the salts into the disperse medium forming micellar colloidal particles. These micellar colloids are formed through weak intermolecular forces, e.g., Van der Waals forces, etc. Micellar colloids represent a type of agglomerate particle as discussed hereinabove. Because of the molecular orientation in these micellar colloidal particles, such particles are characterized by a metal containing layer (i.e., the solid metal-containing particles and any metal present in the polar substituent of the third component, such as the metal in a sulfonic or carboxylic acid salt group), a hydrophobic layer formed by the hydrophobic portions of the molecules of the third component and a polar layer bridging said metal-containing layer and said hydrophobic layer, said polar bridging layer comprising the polar substituents of the third component of the system, e.g., the

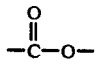

group if the third component is an alkaline earth metal carboxylate.

The second component of the colloidal disperse system is the dispersing medium. The identity of the medium is not a particularly critical aspect of the invention as the medium primarily serves as the liquid vehicle in which solid particles are dispersed. The medium can have components characterized by relatively low boiling points, e.g., in the range of 25° to 120° C. to facilitate subsequent removal of a portion or substantially all of the medium from the compositions of the invention or the components can have a higher boiling point to protect against removal from such compositions upon standing or heating. There is no criticality in an upper boiling point limitation on these liquids.

Representative liquids include mineral oils, alkanes of five to eighteen carbons, cycloalkanes of five or more carbons, corresponding alkyl-substituted cycloalkanes, aryl hydrocarbons, alkylaryl hydrocarbons, ethers such as dialkyl ethers, alkyl aryl ethers, cycloalkyl ethers, cycloalkylalkyl ethers, alkanols, alkylene glycols, polyalkylene glycols, alkyl ethers of alkylene glycols and polyalkylene glycols, dibasic alkanoic acid diesters, silicate esters, and mixtures of these. Specific examples include petroleum ether, Stoddard Solvent, pentane, hexane, octane, isooctane, undecane, tetradecane, cyclopentane, cyclohexane, isopropylcyclohexane, 1,4-dimethylcyclohexane, cyclooctane, benzene, toluene, xylene, ethyl benzene, tert-butyl-benzene, mineral oils, n-propylether, isopropylether, isobutylether, n-amylether, methyl-n-amylether, cyclohexylether, ethoxycyclohexane, methoxybenzene, isopropoxybenzene, p-methoxytoluene, methanol, ethanol, propanol, isopropanol, hexanol, n-octyl alcohol, n-decyl alcohol, alkylene glycols such as ethylene glycol and propylene glycol, diethyl ketone, dipropyl ketone, methylbutyl ketone, acetophenone, 1,2-difluorotetrachloroethane, dichlorofluoromethane, trichlorofluoromethane, acetamide, dimethylacetamide diethylacetamide, propionamide, diisooctyl azelate, ethylene glycol, polypropylene glycols, hexa-2-ethylbutoxy disiloxane, etc. Other dispersing media which may be used are mentioned in U.S. Pat. No. 4,468,339, column 9, line 29, to column 10, line 6, which is hereby incorporated by reference.

Also useful as dispersing media are the low molecular weight, liquid polymers, generally classified as oligomers, which include dimers, tetramers, pentamers, etc. Illustrative of this large class of materials are such liquids as the propylene tetramers, isobutylene dimers, low molecular weight polyolefins, such as poly(α-olefins), and the like.

From the standpoint of availability, cost, and performance, the alkyl, cycloalkyl, and aryl hydrocarbons represent a preferred class of disperse mediums. Liquid petroleum fractions represent another preferred class of disperse mediums. Included within these preferred classes are benzenes and alkylated benzenes, cycloalkanes and alkylated cycloalkanes, cycloalkenes and alkylated cycloalkenes such as found in naphthene-based petroleum fractions, and the alkanes such as found in the paraffin-based petroleum fractions. Petroleum ether, naphthas, mineral oils, Stoddard Solvent, toluene, xylene, etc., and mixtures thereof are examples of economical sources of suitable inert organic liquids which can function as the disperse medium in the colloidal disperse systems of the present invention. Mineral oil can serve by itself as the disperse medium and is preferred as an environmentally innocuous disperse medium.

In addition to the solid, metal-containing particles and the disperse medium, the disperse systems employed herein require a third component. This third component is an organic compound which is soluble in the disperse medium, and the molecules of which are characterized by a hydrophobic portion and at least one polar substituent. As explained, infra, the organic compounds suitable as a third component are extremely diverse. These compounds are inherent constituents of the disperse systems as a result of the methods used in preparing the systems. Further characteristics of the components are apparent from the following discussion of methods for preparing the colloidal disperse systems.

A preferred class of overbased materials used as starting materials in the preparation of the disperse systems of the present invention are the alkaline earth metal-overbased water-insoluble organic acids, preferably those containing at least eight aliphatic carbons although the acids may contain as few as six aliphatic carbon atoms if the acid molecule includes an aromatic ring such as phenyl, naphthyl, etc. Representative organic acids suitable for preparing these overbased materials are discussed and identified in detail in the above-cited patents. Particularly U.S. Pat. Nos. 2,616,904 and 2,777,874 disclose a variety of very suitable organic acids.

For reasons of economy and performance, overbased carboxylic and sulfonic acids are particularly suitable.

Illustrative of the carboxylic acids are tall oil fatty acids, abietic acid, palmitic acid, palmitoleic acid, stearic acid, myristic acid, oleic acid, linoleic acid, linolenic acid, ricinoleic acid, behenic acid, tetrapropylene-substituted glutaric acid, polyisobutene substituted succinic acid, polypropylene-substituted succinic acid, octadecyl-substituted adipic acid, chlorostearic acid, 9-methylstearic acid, dichlorostearic acid, stearylbenzoic acid, eicosane-substituted naphthoic acid, dilauryl-decahydronaphthalene carboxylic acid, didodecyl-tetralin carboxylic acid, dioctylcyclohexane carboxylic acid, mixtures of these acids, their alkali and alkaline earth metal salts, and/or their anhydrides.

Of the sulfonic acids, the mono-, di-, and tri-aliphatic hydrocarbon substituted aryl sulfonic acids and the petroleum sulfonic acids (petrosulfonic acids) are particularly preferred. Illustrative examples of suitable sulfonic acids include mahogany sulfonic acids, petrolatum sulfonic acids, monoeicosane-substituted naphthalene sulfonic acids dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polyisobutene having a molecular weight of 1500 with chlorosulfonic acid, nitronaphthalenesulfonic acid, paraffin wax sulfonic acid, cetylcyclopentane sulfonic acid, laurylcyclohexanesulfonic acids, polyethylene sulfonic acids, etc.

It is necessary that the size and number of aliphatic groups on the acids be sufficient to render the acids soluble. Normally the aliphatic groups will be alkyl and/or alkenyl groups such that the total number of aliphatic carbons is at least eight.

Within this preferred group of overbased carboxylic and sulfonic acids, the calcium, sodium, magnesium, lithium, and barium overbased mono-, di-, and tri-alkylated benzene and naphthalene (including hydrogenated forms thereof) petrosulfonic acids and higher fatty acids are preferred.

Illustrative of the synthetically produced alkylated benzene and naphthalene sulfonic acids are those containing alkyl substituents having from 8 to about 30 carbon atoms therein. Such acids include di-isododecylbenzene sulfonic acid, wax-substituted phenol sulfonic acid, wax-substituted benzene sulfonic acids, polybutene-substituted sulfonic acid, cetyl-chlorobenzene sulfonic acid, di-cetylnaphthalene sulfonic acid, di-lauryldiphenylether sulfonic acid, di-isononylbenzene sulfonic acid, di-isooctadecylbenzene sulfonic acid, stearylnaphthalene sulfonic acid, and the like. The petroleum sulfonic acids are a well known art recognized class of materials which have been used as starting materials in preparing overbased products since the inception of overbasing techniques as illustrated by the above patents. Petroleum sulfonic acids are obtained by treating refined or semi-refined petroleum oils with concentrated or fuming sulfuric acid. These acids remain in the oil after the settling out of sludges. These petroleum sulfonic acids, depending on the nature of the petroleum oils from which they are prepared, are oil-soluble alkane sulfonic acids, alkyl-substituted cycloaliphatic sulfonic acids including cycloalkyl sulfonic acids and cycloalkene sulfonic acids, and alkyl, alkaryl, or aralkyl substituted hydrocarbon aromatic sulfonic acids including single and condensed aromatic nuclei as well as partially hydrogenated forms thereof. Examples of such petrosulfonic acids include mahogany sulfonic acid, white oil sulfonic acid, petrolatum sulfonic acid, petroleum naphthene sulfonic acid, etc.

The especially preferred group of aliphatic fatty acids includes the linear unsaturated higher fatty acids containing from about 8 to about 30 carbon atoms, more preferably from about 12 to about 22 carbon atoms, and most preferably from about 16 to about 20 carbon atoms. Illustrative of these acids are tall oil fatty acids, linoleic acid, abietic acid, linolenic acid, palmitoleic acid, oleic acid, and ricinoleic acid. Tall oil fatty acids are most preferred.

As shown by the representative examples of the preferred classes of sulfonic and carboxylic acids, the acids may contain nonhydrocarbon substituents such as halo, nitro, alkoxy, hydroxyl, and the like, although those having less than 5% by number nonhydrocarbon substituents are preferred.

It is desirable that the overbased materials used to prepare the disperse system have a metal ratio of at least about 1.1 and preferably about 4.0. An especially suitable group of the preferred sulfonic acid and carboxylic acid overbased materials has a metal ratio of at least about 7.0. While overbased materials having a metal ratio of 75 have been prepared, normally the maximum metal ratio will not exceed about 50 and, in most cases, not more than about 40.

The overbased materials used in preparing the colloidal disperse systems utilized in the compositions of the invention contain from about 10% to about 70% by weight of metal-containing components. As explained hereafter, the exact nature of these metal containing components is not known. It is theorized that the metal base, the acidic material, and the organic material being overbased form a metal complex, this complex being the metal-containing component of the overbased material. On the other hand, it has also been postulated that the metal base and the acidic material form amorphous metal compounds which are dissolved in the inert organic reaction medium and the material which is said to be overbased. The material which is overbased may itself be a metal-containing compound, e.g., a carboxylic or sulfonic acid metal salt. In such a case, the metal containing components of the overbased material would be both the amorphous compounds and the acid salt. The remainder of the overbased materials comprise the inert organic reaction medium and any promoter which is not removed from the overbased product. For purposes of this application, the organic material which is subjected to overbasing is considered a part of the metal-containing components. Normally, the liquid reaction medium constitutes at least about 30% by weight of the reaction mixture utilized to prepare the overbased materials.

As mentioned above, the colloidal disperse systems used in the composition of the present invention are prepared by homogenizing a "conversion agent" and the overbased starting material. Homogenization is achieved by vigorous agitation of the two components, preferably at the reflux temperature or a temperature slightly below the reflux temperature. The reflux temperature normally will depend upon the boiling point of the conversion agent. However, homogenization may be achieved within the range of about 25° C. to about 200° C. or slightly higher. Usually, there is no real advantage in exceeding 150° C.

The concentration of the conversion agent necessary to achieve conversion of the overbased material is usually within the range of from about 1% to about 80% based upon the weight of the overbased material, excluding the weight of the inert organic solvent and any promoter present therein. Preferably at least about 10% and usually less than about 60% by weight of the conversion agent is employed. Concentrations beyond 60% appear to afford no additional advantages.

The terminology "conversion agent" as used herein is intended to describe a class of very diverse materials which possess the property of being able to convert the Newtonian homogeneous, single-phase, overbased materials into non-Newtonian colloidal disperse systems. The mechanism by which conversion is accomplished is not completely understood. However, with the exception of carbon dioxide, these conversion agents all possess active hydrogens. The conversion agents include lower aliphatic carboxylic acids, water, aliphatic alcohols, cycloaliphatic alcohols, arylaliphatic alcohols, phenols, ketones, aldehydes, amines, boron acids, phosphorus acids, and carbon dioxide. Mixtures of two or more of these conversion agents are also useful. Particularly useful conversion agents are discussed below.

The lower aliphatic carboxylic acids are those containing less than about eight carbon atoms in the molecule. Examples of this class of acids are formic acid, acetic acid, propionic acid, butyric acid, valeric acid, isovaleric acid, isobutyric acid, caprylic acid, heptanoic acid, chloroacetic acid, dichloroacetic acid, trichloroacetic acid, etc. Formic acid, acetic acid, and propionic acid are preferred, with acetic acid being especially suitable. It is to be understood that the anhydrides of these acids are also useful and, for the purposes of the specification and claims of this invention, the term acid is intended to include both the acid per se and the anhydride of the acid.

Useful alcohols include aliphatic, cycloaliphatic, and arylaliphatic mono- and polyhydroxy alcohols. Alcohols having less than about twelve carbons are especially useful, while the lower alkanols, i.e., alkanols having less than about eight carbon atoms are preferred for reasons of economy and effectiveness in the process. Illustrative are the alkanols such as methanol, ethanol, isopropanol, n-propanol, isobutanol, tertiary butanol, isooctanol, dodecanol, n-pentanol, etc.; cycloalkyl alcohols exemplified by cyclopentathol, cyclohexanol, 4-methylcyclohexanol, 2-cyclohexylethanol, cyclopentylmethanol, etc.; phenyl aliphatic alkanols such as benzyl alcohol, 2-phenylethanol, and cinnamyl alcohol; alkylene glycols of up to about six carbon atoms and mono-lower alkyl ethers thereof such as monomethylether of ethylene glycol, diethylene glycol, ethylene glycol, trimethylene glycol, hexamethylene glycol, triethylene glycol, 1,4-butanediol, 1,4-cyclohexanediol, glycerol, and pentaerythritol.

The use of a mixture of water and one or more of the alcohols is especially effective for converting the overbased material to colloidal disperse systems. Such combinations often reduce the length of time required for the process. Any water-alcohol combination is effective, but a very effective combination is a mixture of one or more alcohols and water in a weight ratio of alcohol to water of from about 0.05:1 to about 24:1. Preferably, at least one lower alkanol is present in the alcohol component of these water-alkanol mixtures. Water-alkanol mixtures wherein the alcoholic portion is one or more lower alkanols are especially suitable.

Phenols suitable for use as conversion agents include phenol, naphthol, ortho-cresol, para-cresol, catechol, mixtures of cresol, para-tert-butylphenol, and other lower alkyl substituted phenols, meta-polyisobutene (M.W.-350)-substituted phenol, and the like.

Other useful conversion agents include lower aliphatic aldehydes and ketones, particularly lower alkyl aldehydes and lower alkyl ketones such as acetaldehydes, propionaldehydes, butyraldehydes, acetone, methylethyl ketone, diethyl ketone. Various aliphatic, cycloaliphatic, aromatic, and heterocyclic amines are also useful providing they contain at least one amino group having at least one active hydrogen attached thereto. Illustrative of these amines are the mono- and di-alkylamines, particularly mono- and and di-lower alkylamines, such as methylamine, ethylamine, propylamine, dodecylamine, methyl ethylamine, diethylamine; the cycloalkylamines such as cyclohexylamine, cyclopentylamine, and the lower alkyl substituted cycloalkylamines such as 3-methylcyclohexylamine; 1,4-cyclohexylenediamine; arylamines such as aniline, mono-, di-, and tri-, lower alkylsubstituted phenyl amines, naphthylamines, 1,4-phenylene diamines; lower alkanol amines such as ethanolamine and diethanolamine; alkylenediamines such as ethylene diamine, triethylene tetramine, propylene diamines, octamethylene diamines; and heterocyclic amines such as piperazine, 4-aminoethylpiperazine, 2-octadecyl-imidazoline, and oxazolidine. Boron acids are also useful conversion agents and include boronic acids (e.g., alkyl-$B(OH)_2$ or aryl-$B(OH_2)$), boric acid (i.e., $H_3BO_3$), tetraboric acid, metaboric acid, and esters of such boron acids.

The phosphorus acids are useful conversion agents and include the various alkyl and aryl phosphinic acids, phosphinus acids, phosphonic acids, and phosphonous acids. Phosphorus acids obtained by the reaction of lower alkanols or unsaturated hydrocarbons such as polyisobutenes with phosphorus oxides and phosphorus sulfides are particularly useful, e.g., $P_2O_5$ and $P_2S_5$.

Carbon dioxide can be used as the conversion agent. However, it is preferable to use this conversion agent in combination with one or more of the foregoing conversion agents. For example, the combination of water and carbon dioxide is particularly effective as a conversion agent for transforming the overbased materials into a colloidal disperse system.

As previously mentioned, the overbased materials are single phase homogeneous systems. However, depending on the reaction conditions and the choice of reactants in preparing the overbased materials, there sometimes are present in the product insoluble contaminants. These contaminants are normally unreacted basic materials such as calcium oxide, barium oxide, calcium hydroxide, barium hydroxide, or other metal base materials used as a reactant in preparing the overbased material. It has been found that a more uniform colloidal disperse system results if such contaminants are removed prior to homogenizing the overbased material with the conversion agents. Accordingly, it is preferred that any insoluble contaminants in the overbased materials be removed prior to converting the material in the colloidal system. The removal of such contaminants is easily accomplished by conventional techniques such as filtration or centrifugation. It should be understood, however, that the removal of these contaminants, while desirable for reasons just mentioned, is not an essential aspect of the invention and useful products can be obtained when overbased materials containing insoluble contaminants are converted to the colloidal disperse systems.

The conversion agents, or a proportion thereof, may be retained in the colloidal disperse system. The conversion agents are, however, not essential components of these disperse systems and it is usually desirable that as little of the conversion agents as possible be retained in the disperse systems. Since these conversion agents do not react with the overbased material in such a manner as to be permanently bound thereto through some type of chemical bonding, it is normally a simple matter to remove a major proportion of the conversion agents and, generally, substantially all of the conversion agents. Some of the conversion agents have physical properties which make them readily removable from the disperse systems. Thus, most of the free carbon dioxide gradually escapes from the disperse system during the homogenization process or upon standing thereafter. Since the liquid conversion agents are generally more volatile than the remaining components of the disperse system, they are readily removable by conventional devolatilization techniques, e.g., heating, heating at reduced pressures, and the like. For this reason, it may be desirable to select conversion agents which will have boiling points which are lower than the remaining components of the disperse system. This is another reason why the lower alkanols, mixtures thereof, and lower alkanol-water mixtures are preferred conversion agents.

Again, it is not essential that all of the conversion agent be removed from the disperse systems. In fact, useful disperse systems for employment in the resinous compositions of the invention result without removal of the conversion agents. However, from the standpoint of achieving uniform results, it is generally desirable to remove the conversion agents, particularly where they are volatile.

To better illustrate the colloidal disperse systems utilized in the invention, the procedure for preparing a preferred system is described below. Unless otherwise stated, all parts, percents, ratios, and the like are by weight, temperature is degrees Centigrade and room temperature (about 25° C.), and pressure is in atmospheres and about one atmosphere.

As stated above, materials for preparing an overbased product generally include (1) the organic material to be overbased, (2) an inert, nonpolar, organic solvent for the organic material, (3) a metal base, (4) a promoter, and (5) an acidic material. In this example, these materials are (1) calcium petrosulfonate, (2) mineral oil, (3) calcium hydroxide, (4) a mixture of methanol, isobutanol, and n-pentanol, and (5) carbon dioxide.

A reaction mixture of 1305 grams of calcium sulfonate having a metal ratio of 2.5 dissolved in mineral oil, 220 grams of methyl alcohol, 72 grams of isobutanol, and 38 grams of n-pentanol is heated to 35° C. and subjected to the following operating cycle four times: mixing with 143 grams of 90% calcium hydroxide and treating the mixture with carbon dioxide until it has a neutralization base number of 32–39 when referenced against a phenolphthalein indicator. The resulting product is then heated to 155° C. during a period of 9 hours to remove the alcohols and then filtered at this temperature. The filtrate is a calcium overbased petrosulfonate having a metal ratio of 12.2.

A mixture of 150 parts of the foregoing overbased material, 15 parts of methyl alcohol, 10.5 parts of n-pentanol and 45 parts of water is heated under reflux conditions at 71°–74° C. for 13 hours. The mixture becomes a gel. It is then heated to 144° C. over a period of 6 hours and diluted with 126 parts of mineral oil having a viscosity of 2000 SUS at 100° F. and the resulting mixture heated at 144° C. for an additional 4.5 hours with stirring. This thickened product is a colloidal disperse system of the type contemplated by the present invention.

The disperse systems are characterized by three components: (1) solid metal-containing particles formed in situ, (2) an inert, non-polar, organic liquid which functions as the disperse medium, and (3) an organic compound which is soluble in the disperse medium and the molecules of which are characterized by a hydrophobic portion and at least one polar substituent. In the colloidal disperse system described immediately above, these components are as follows: (1) calcium carbonate in the form of solid particles, (2) mineral oil, and (3) calcium petrosulfonate.

From the foregoing example, it is apparent that the solvent for the material which is overbased becomes the colloidal disperse medium or a component thereof. Of course, mixtures of other inert liquids can be substituted for the mineral oil or used in conjunction with the mineral oil prior to forming the overbased material.

It is also readily seen that the solid metal-containing particles formed in situ possess the same chemical composition as would the reaction products of the metal base and the acidic material used in preparing the overbased materials. Thus, the actual chemical identity of the metal containing particles formed in situ depends upon both the particular metal base or bases employed and the particular acidic material or materials reacted therewith. For example, if the metal base used in preparing the overbased material were calcium oxide and if the acidic material was a mixture of formic and acetic acids, the metal-containing particles formed in situ would be calcium formates and calcium acetates.

However, the physical characteristics of the particles formed in situ in the conversation step are quite different from the physical characteristics of any particles present in the homogeneous single-phase overbased material which is subjected to the conversion. Particularly, such physical characteristics as particle size and structure are quite different. The solid metal-containing particles of the colloidal disperse systems (i.e., component (B) (II)) are of a size sufficient for detection by X-ray diffraction. The overbased material prior to conversion (i.e., component (B) (I)) is not characterized by the presence of these detectable particles.

X-ray diffraction and electron microscope studies have been made of both overbased organic materials and colloidal disperse systems prepared therefrom. These studies establish the presence in the disperse systems of the solid metal-containing salts. For example, in the disperse system prepared according to the above, the calcium carbonate is present as solid calcium carbonate having a particle size of about 40 to 50 Å (unit particle size) and interplanar spacing (d Å) of 3.035. But X-ray diffraction studies of the overbased material from which it was prepared indicate the absence of calcium carbonate of this type. In fact, calcium carbonate present as such, if any, appears to be amorphous and in solution. While applicant does not intend to be bound by any theory offered to explain the changes which accompany the conversion step, it appears that conversion permits particle formation and growth. That is, the amorphous, metal-containing, apparently dissolved salts or complexes present in the overbased material form solid, metal-containing particles which by a process of particle growth become colloidal particles. Thus, in the above example, the dissolved amorphous calcium carbonate salt or complex is transformed into solid particles which then "grow". In this example, they grow to a size of 40 to 50 Å. In many cases, these particles apparently are crystallites.

Regardless of the correctness of the postulated mechanism for in situ particle formation, the fact remains that no particles of the type predominant in the disperse systems are found in the overbased materials from which they are prepared. Accordingly, they are unquestionably formed in situ during conversion.

As these solid metal-containing particles formed in situ come into existence, they do so as pre-wet, pre-dispersed solid particles which are inherently uniformly distributed throughout the other components of the disperse system. The liquid disperse medium containing these pre-wet dispersed particles is readily incorporated into various polymeric compositions thus facilitating the uniform distribution of the particles throughout the polymeric resin composition. This pre-wet, pre-dispersed character of the solid metal-containing particles resulting from their in situ formation is, thus, an important feature of the disperse systems.

In the foregoing example, the third component of the disperse system of component (B)(II) (i.e., the organic compound which is soluble in the disperse medium and which is characterized by molecules having a hydrophobic portion and a polar substituent) is calcium petrosulfonate,

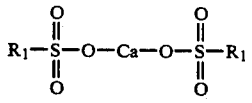

wherein $R_1$ is the residue of the petrosulfonic acid. In this case, the hydrophobic portion of the molecule is the hydrocarbon moiety of petrosulfonic, i.e., $-R_1$. The polar substituent is the metal salt moiety,

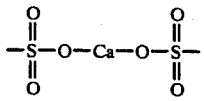

The hydrophobic portion of the organic compound is a hydrocarbon radical or a substantially hydrocarbon radical containing at least about eight aliphatic carbon atoms. Usually the hydrocarbon portion is an aliphatic or cycloaliphatic hydrocarbon radical although aliphatic or cycloaliphatic substituted aromatic hydrocarbon radicals are also suitable. In other words, the hydrophobic portion of the organic compound is the residue of the organic material which is overbased minus its polar substituents. For example, if the material to be overbased is a carboxylic acid, sulfonic acid, or phosphorus acid, the hydrophobic portion is the residue of these acids which would result from the removal of the acid functions. Similarly, if the material to be overbased is a phenol, a nitro-substituted polyolefin, or an amine, the hydrophobic portion of the organic compound is the radical resulting from the removal of the hydroxyl, nitro, or amino group respectively. It is the hydrophobic portion of the molecule which renders the organic compound soluble in the solvent used in the overbasing process and later in the disperse medium.

Obviously, the polar portions of these organic compounds are the polar substituents such as the acid salt moiety discussed above. When the material to be overbased contains polar substituents which will react with the basic metal compound used in overbasing, for example, acid groups such as carboxy, sulfino, hydroxysulfonyl, and phosphorus acid groups or hydroxyl groups, the polar substituent of the third component is the polar group formed from the reaction. Thus, the polar substituent is the corresponding acid metal salt group or hydroxyl group metal derivative, e.g., an alkali or alkaline earth metal sulfonate, carboxylate, sulfinate, alcoholate, or phenate.

On the other hand, some of the materials to be overbased contain polar substituents which ordinarily do not react with metal bases. These substituents include nitro, amino, ketocarboxyl, carboalkoxy, etc. In the disperse systems derived from overbased materials of this type the polar substituents in the third component are unchanged from their identity in the material which was originally overbased.

The identity of the third essential component of the disperse system depends upon the identity of the starting materials (i.e., the material to be overbased and the metal base compound) used in preparing the overbased material. Once the identity of these starting materials is known, the identity of the third component in the colloidal disperse system is automatically established. Thus, from the identity of the original material, the identity of the hydrophobic portion of the third component in the disperse system is readily established as being the residue of that material minus the polar substituents attached thereto. The identity of the polar substituents on the third component is established as a matter of chemistry. If the polar groups on the material to be overbased undergo reaction with the metal base, for example, if they are acid functions, hydroxy groups, etc., the polar substituent in the final product will correspond to the reaction product of the original substituent and the metal base. On the other hand, if the polar substituent in the material to be overbased is one which does not react with metal bases, then the polar substituent of the third component is the same as the original substituent.

As previously mentioned, this third component can orient itself around the metal-containing particles to form micellar colloidal particles. Accordingly, it can exist in the disperse system as an individual liquid component dissolved in the disperse medium or it can be associated with the metal-containing particles as a component of micellar colloidal particles.

The specifics on how to make a variety of metal overbased colloidal disperse systems from various metal overbased materials are known and disclosed in a number of U.S. patents. Examples 1–84 at column 18, line 37, to column 38, line 13, of U.S. Pat. No. 4,468,339, the description of which is hereby fully incorporated herein by reference, illustrate various overbased materials (i.e., component (B)(I)) and colloidal disperse systems (i.e., component (B)(II)) prepared from these overbased materials. Examples 1 through 43 are directed to the preparation of (B)(I) Newtonian overbased materials illustrative of the types which can be used as an additive to the non-Newtonian compositions of the present invention or to prepare the (B)(II) non-Newtonian colloidal disperse systems.

The change in rheological properties associated with conversion of a Newtonian overbased material into a non-Newtonian colloidal disperse system is demonstrated by the Brookfield Viscometer data derived from overbased materials and colloidal disperse systems prepared therefrom. Such data is disclosed in column 38, lines 13–63, of the above mentioned U.S. Pat. No. 4,468,339, and this disclosure is hereby fully incorporated herein by reference. This disclosure is reproduced in part below:

BROOKFIELD VISCOMETER DATA
(Centipoises)

| | Sample A | | Sample B | | Sample C | | Sample D | |
|---|---|---|---|---|---|---|---|---|
| R.p.m. | (1) | (2) | (1) | (2) | (1) | (2) | (1) | (2) |
| 6 | 230 | 2,620 | 80 | 15,240 | 240 | 11,320 | 114 | 8,820 |
| 12 | 235 | 2,053 | 90 | 8,530 | 230 | 6,980 | 103 | 5,220 |
| 30 | 239 | * | 88 | * | 224 | 4,008 | 100 | 2,892 |

*Off scale

The samples each are identified by two numbers, (1) and (2). The first comprises the overbased material and the second comprises the colloidal disperse system. The overbased materials of the samples are further characterized as follows:

SAMPLE A

Calcium overbased petrosulfonic acid having a metal ratio of about 12.2.

SAMPLE B

Barium overbased oleic acid having a metal ratio of about 3.5

SAMPLE C

Barium overbased petrosulfonic acid having a metal ratio of about 2.5.

SAMPLE D

Calcium overbased commercial higher fatty acid mixture having a metal ratio of about 5.

The data of all samples is collected at 25° C.

By comparing column (1) with column (2) for each sample, it can be seen that the colloidal disperse system has a far greater viscosity than the overbased starting material.

The following are examples illustrating preparation of metal overbased colloidal disperse systems for use in the present invention. The term "neutralization base number" refers to a base number referenced against a phenolphthalein indicator.

EXAMPLE 1

A normal calcium mahogany sulfonate is prepared by metathesis of a 60% oil solution of sodium mahogany sulfonate (750 parts by weight) with a solution of 67 parts of calcium chloride and 63 parts of water. The reaction mass is heated for 4 hours at 90° to 100° C. to effect the conversion of the sodium mahogany sulfonate to calcium mahogany sulfonate. Then 54 parts of lime is added and the whole is heated to 150° C. over a period of 5 hours. When the whole has cooled to 40° C., 98 parts of methanol is added and 152 parts of carbon dioxide is introduced over a period of 20 hours at 42°-43° C. Water and alcohol are then removed by heating the mass to 150° C. The residue in the reaction vessel is diluted with 100 parts of low viscosity mineral oil. The filtered oil solution of the desired carbonated calcium sulfonate overbased material shows the following analysis: sulfate ash content, 16.4%; neutralization base number, 0.6 (acidie); and a metal ratio of 2.50. By adding barium or calcium oxide or hydroxide to this product with subsequent carbonation, the metal ratio can be increased to a ratio of 3.5 or greater as desired.

EXAMPLE 2

A mixture comprising 1,595 parts of the overbased material of Example 1 (1.54 equivalents based on sulfonic acid anion), 167 parts of the calcium phenate prepared as indicated below (0.19 equivalent), 616 parts of mineral oil, 157 parts of 91% calcium hydroxide (3.86 equivalents), 288 parts of methanol, 88 parts of isobutanol, and 56 parts of mixed isomeric primaryamyl alcohols (containing about 65% normal amyl, 3% isoamyl and 32% of 2-methyl-1-butyl alcohols) is stirred vigorously at 40° C. and 25 parts of carbon dioxide is introduced over a period of 2 hours at 40°-50° C. Thereafter, three additional portions of calcium hydroxide, each amounting to 1.57 parts, are added and each such addition is followed by the introduction of carbon dioxide as previously illustrated. After the fourth calcium hydroxide addition and the carbonation step is completed, the reaction mass is carbonated for an additional hour at 43°-47° C. to reduce neutralization base number of the mass to 4.0. The substantially neutral, carbonated reaction mixture is freed from alcohol and any water of reaction by heating to 150° C. and simultaneously blowing it with nitrogen. The residue in the reaction vessel is filtered. The filtrate, an oil solution of the desired substantially neutral, carbonated calcium sulfonate overbased material of high metal ratio, shows the following analysis: sulfate ash content, 41.11%; neutralization number 0.9 (basic); and a metal ratio of 12.5.

The calcium phenate used above is prepared by adding 2,250 parts of mineral oil, 960 parts (5 moles) of heptylphenol, and 50 parts of water into a reaction vessel and stirring at 25° C. The mixture is heated to 40° C. and 7 parts of calcium hydroxide and 231 parts (7 moles) of 91% commercial paraformaldehyde is added over a period of 1 hour. The whole is heated to 80° C. and 200 additional parts of calcium hydroxide (making a total of 207 parts or 5 moles) is added over a period of 1 hour at 80°-90° C. The whole is heated to 150° C. and maintained at that temperature for 12 hours while nitrogen is blown through the mixture to assist in the removal of water. If foaming is encountered, a few drops of polymerized dimethyl silicone foam inhibitor may be added to control the foaming. The reaction mass is then filtered. The filtrate, a 33.6% oil solution of the desired calcium phenate of heptylphenol-formaldehyde condensation product is found to contain 7.56% sulfate ash.

EXAMPLE 3

A mixture of 1,000 parts of the product of Example 2, 303 parts of mineral oil, 80 parts of methanol, 40 parts of mixed primary amyl alcohols (containing about 65% by weight of normal amyl alcohol, 3% by weight of isoamyl alcohol, and 32% by weight of 2-methyl-1-butyl alcohol) and 80 parts of water are introduced into a reaction vessel and heated to 70° C. and maintained at that temperature for 4.2 hours. The overbased material is converted to a gelatinous mass, the latter is stirred and heated at 150° C. for a period of about 2 hours to remove substantially all the alcohols and water. The residue is a dark green gel, which is a particularly useful colloidal disperse system.

EXAMPLE 4

A solution of 1,303 parts of the gell like colloidal disperse system of Example 3 and 563 parts of mineral oil are dissolved in 1,303 parts of toluene by continuous agitation of these two components for about three hours. Added to this mixture is 40 parts of water and 40 parts of methanol followed by the slow addition of 471 parts of 91% calcium hydroxide with continuous stirring. An exothermic reaction takes place raising the temperature to 32° C. The entire reaction mass is then heated to about 60° C. over a 0.25 hour period. Two hundred-eighty parts of carbon dioxide is then charged over a five hour period while maintaining the temperature at 60°-70° C. At the conclusion of the carbonation, the mass is heated to about 150° C. over a 0.75 hour period to remove water, methanol, and toluene. The resulting product, a clear, light brown colloidal disperse system in the form of a gel has the following analysis: sulfate ash content, 46.8%; a neutralization base number, as measured against phenolphthalein, of less than 1.0; and a metal ratio of 36.0. In the above-described procedure, additional metal containing particles are incorporated into the colloidal disperse system of Example 3 and its base neutralization number decreased to give a non-Newtonian colloidal disperse system useful in the invention of this application.

EXAMPLE 5

To 1045 parts of Semtol-70 Oil TM (a medium boiling mineral oil commercially available from Witco Corporation), 487 parts PM3101 TM (a mixture of 61% by weight isobutanol and 39% by weight primary amyl alcohol (containing 57–70% n-amyl alcohol) commercially available from Union Carbide Corp.), and 162 parts Mississippi Codex Lime (97% available CaOH) is added 1000 parts oleic acid over a period of 3 hours. The mixture is heated to 170° F. to complete the acid neutralization. After cooling the batch to 105° F., 119 parts methanol and 726.5 parts of the Mississippi Codex Lime are added. This mixture is carbonated by blowing carbon dioxide through the under-surface inlet tube until the neutralization base number is about zero. The alcohol promoter and water are removed by flash drying, the material is cooled, solvent clarified with hexane, and vacuum stripped to 300° F. and 70 mm absolute Hg.

The final product is essentially environmentally safe, non-toxic, calcium overbased oleic acid having a metal ratio of 9.0.

EXAMPLE 6

To 50 parts of the product produced according to Example 5 are added 100 parts mineral oil, which is charged to a 10 gallon glass-lined reactor equipped with a stirrer, thermowell, sub-surface gas inlet and a side-arm trap with a reflux condenser. The mixture is heated with stirring to 150° F. 22.5 parts of the PM3101 TM described in Example 5 above and 7.5 parts tap water are charged to the reactor and the reactor is maintained at 150° F. with stirring for about 16 hours.

Water and alcohol is removed by conducting a nitrogen head-space purge while heating to 310° F. over a 5-hour period. The mixture is then vacuum-stripped to 10 mm. Hg and 310° to 320° F. to remove additional volatile materials and cooled to room temperature with stirring. The product is the desired non-Newtonian metal overbased colloidal disperse system for use in the present invention in which the metal is calcium and the anion is oleate. The Brookfield Viscometer data for the product produced in Example 6 is tabulated below. The data is collected at 25° C.

| BROOKFIELD VISCOMETER DATA (Centipoises) | |
|---|---|
| R.p.m. | Product obtained in Example 6 |
| 2 | 201,000 |
| 4 | 108,000 |
| 10 | 47,500 |
| 20 | 26,000 |

The thixotropic index, indicating gel strength may be calculated from the viscosity at 2 r.p.m. divided by the viscosity at 20 r.p.m. In this case, the product according to Example 6 has a thixotropic index of 7.7. Since a thixotropic index greater than 1.0 indicates gel (i.e., non-Newtonian) behavior, the above data shows that the product according to Example 6 has the rheology of a non-Newtonian gel.

As mentioned above, the colloidal disperse systems contain solid metal-containing particles which remain dispersed in the dispersing medium as colloidal particles. Ordinarily, the particles will not exceed 5.0 microns. However, by repeating certain portions of steps taken to produce the gelled overbased materials, it is possible to produce colloidal systems having a higher concentration of solid metal-containing particles and/or systems having a greater number average particle size than that obtained without such a procedure. This procedure, which the inventors call "rebasing", is basically the same as the general procedure for making non-Newtoian colloidal disperse systems described above, except that after the gellation process begins and before removing any volatile conversion agents from the reaction mixture, the gellation process is momentarily discontinued, additional inert, non-polar, organic solvent and metal base are added to the mixture, and the gellation process is resumed and completed as usual. This rebasing method of preparing a colloidal disperse system for use in the present invention is illustrated by the following example.

EXAMPLE 7

About 107 parts of the overbased calcium sulfonate made according to Example 2 above and 1459 parts of a mineral oil are charged to a 12 liter resin pot having a stirrer, heating mantle, thermocouple, side-arm condensate trap, water-cooled condenser, and under-surface gas inlet tube. The mixture is heated to 130° F. over a one-half hour period.

The heated mixture is carbonated by blowing with carbon dioxide through the under-surface gas inlet tube over a period of 30 to 50 minutes at approximately 130° to 140° F. until the mixture has a base number of zero. Carbonation is discontinued, a mixture of 212 parts methanol and 163 parts water are added to the carbonated mixture, and the mixture is heated to 160° to 180° F. and refluxed in that temperature range for 5 hours, during which there is a significant degree of gellation of the mixture. A measured amount (up to 2,541 parts) of mineral oil and, if necessary, hexane may be added if the increase in viscosity causes difficulty in stirring the reaction mixture. Heating is then reduced or discontinued to stop refluxing and 2,541 parts of diluent oil, less any amount added during the refluxing step, is added, during which time the temperature drops to 135°–140° F. To this mixture is added 1,771 parts calcium hydroxide over a period of 0.5 to 0.67 hour during which the temperature of the mixture is in the range from 135° to 150° F.

The mixture to which the calcium hydroxide has been added is again heated to a reflux temperature and again carbonated to a base number of zero by blowing the mixture with carbon dioxide through the undersurface gas inlet tube. This step generally requires from about 8½ to 12 hours at a reflux temperature of 155° to 180° F. Methanol and water is removed (i.e., stripped off) by purging the reaction mixture with nitrogen gas through the side-arm condensate trap while heating to 300° F. over approximately 1 hour. The stripping off process is completed under a 10 mm Hg vacuum while maintaining the temperature at 300° F. for another one-half hour. The product is filtered through a 60-mesh screen under vacuum while the mixture is still hot, and is then permitted to cool. The product contains about 40% mineral oil.

The Brookfield Viscometer data for the product produced in Example 7 is tabulated below. The data is collected at 25° C.

| BROOKFIELD VISCOMETER DATA (Centipoises) | | | | |
|---|---|---|---|---|
| | Product obtained in Example 7 | | | |
| R.p.m. | −1 | −26 | −30 | −80 |
| 2 | 213,500 | 201,500 | 344,000 | 219,000 |
| 4 | 124,750 | 119,750 | 216,000 | 130,000 |
| 10 | 62,000 | 61,900 | 114,000 | 67,500 |
| 20 | 36,100 | 37,800 | 69,200 | 41,700 |

The thixotropic index, calculated from the viscosity at 2 r.p.m. divided by the viscosity at 20 r.p.m., is 5.9, 5.3, 5.0, and 5.3 for measurements −1, −26, −30 and −80, respectively. This data shows that rebasing produces rheology of a stiff gel that undergoes a substantial decrease in viscosity when force is applied. This surprising increase in thixotropic behavior yields substantial advantages in rail lubricant formulation, since the composition is more likely to remain on the gage face of railway track during repeated passes by railway wheels, reducing the number of applications, and/or total amount of application, required to reduce friction and provide extreme pressure/anti-wear protection.

The above Example 7 is illustrative of rebasing which may be conducted with any of the aforementioned metal overbased materials, including, for example, any of the metal overbased carboxylates, thiocarboxylates, phosphates, and thiophosphates mentioned above, and may be conducted using other acid gases as promoters, by ordinary skill in substituting the appropriate starting materials, promoter, and rebasing materials for those used in Example 7.

Those overbased materials which are preferred among the previously described non-Newtonian colloidal disperse systems are also preferred for use in those systems produced by the above rebasing procedure, such as colloidal systems comprising overbased calcium, sodium, magnesium, lithium, or barium unsaturated linear carboxylates described in further detail above.

The compositions containing the colloidal disperse systems according to the present invention have extremely low coefficients of friction, both static and dynamic. Another aspect of the present invention is the ability to achieve reduction of static friction relative to dynamic friction, reducing the occurrence of a phenomenon known as "stick-slip".

Stick slip may be measured using various test protocol if relative results are desired. One test for stick slip is that utilized by Cincinnati Milacron based on former ASTM procedure D2877-70, which consists of slowly traversing a base block beneath a top block with two ounces of a lubricant sample between the blocks using a Labeco Model 17900 stick-slip machine serial number 17900-5-71, commercially available from Laboratory Equipment Co., Mooresville, Ind., and test blocks made from pearlitic gray iron, HB179-201, available from Bennett Metal Products of Wilmington, Ohio. Deflection resulting from kinetic thrust force is observed while the block is moving from right to left and left to right. Deflection resulting from static thrust force is observed after this movement is terminated. The magnitude of the deflection is determined by dial indicators mounted on the apparatus. From the dial readings, the static coefficient of friction (US), kinetic coefficient of friction (UK), and stick-slip number US/UK are calculated.

Another method by which relative stick slip values may be determined is by using a modified antiwear testing device. A specific example is one in which a flat, self-aligning hardened steel rotor is operated so that it presses against a stationary narrow rimmed disk of an automatic transmission clutch material. The steel rotor is accelerated and then allowed to coast down to zero r.p.m. while loaded against the friction disk submerged in the lubricant test fluid and while speed and torque data are continuously obtained on a recording device. Such a low velocity friction apparatus (LVFA) which can be used to make these measurements may be made as follows:

A Shell Four Ball Test Machine from Precision Scientific Co. (Cat. No. 73603) is modified as follows:

1. The three ball cup, support, heater and torque arm are replaced with a suitable assembly that contains a narrow-rimmed disc instead of the three balls.
2. The single ball spindle arrangement is replaced with a flat rotor that is self-aligning and which rubs against the stationary narrow-rimmed disc.
3. The torque counter is replaced with a strain gauge load beam and chart recorder.
4. A flywheel is added to the rotating shaft to provide additional inertia for high speed decelerations.
5. A variable speed motor with a gear attachment is added for very slow constant speed testing.

The upper rotating specimen is a flat self-aligning rotor made from ketos tool steel hardened to Rockwell C-scale 57 and the lower stationary specimen is a flat, narrow-rimmed disc which, depending on the procedure, may be made of various materials. Before assembly, the rotating steel surfaces (rotors) are polished according to the following schedule to remove all traces of previous wear tracks and debris.

1. Rough Rotor—3-M-ite 180 grit paper
2. Smooth Rotor—3-M-ite 500 grit paper

Both rotors are then thoroughly cleaned in Stoddard solvent and air dried.

The rough disk is installed, 15 cc oil is added, and the assembly is run for 15 minutes under a 30 kg loa at 1000 r.p.m., and then the smooth rotor is installed and run for an additional 5 minutes as a break-in procedure.

This device is then cleaned, the paper clutch material is replaced, and the test lubricant composition is added. The disk is accelerated to 1000 r.p.m. and permitted to decelerate to zero r.p.m., while speed and torque data are continuously obtained by a recording device, such as a chart recorder. The static and dynamic coefficients of friction may be calculated from the rate of deceleration and torque data using standard calculations known in the art, and the stick slip coefficient may be calculated by dividing the static coefficient of friction by the dynamic coefficient of friction.

Besides having the thixotropic properties of a grease, a rail lubricant should have a low coefficient of friction (both static and dynamic) and good extreme pressure/anti-wear properties. One aspect of the present invention is that friction reducing and extreme pressure/anti-wear properties are built into the non-Newtonian colloidal disperse system, avoiding the necessity for auxiliary friction modifiers or auxiliary extreme pressure agents which add to lubricant cost and typically are a significant source of environmental, toxicological and/or cleanliness problems, as shown by the following data.

| Lubricant property | The Product of Example 4 | The Product of Example 6 |
|---|---|---|
| Coefficient of friction with 10 kg of loading: | | |
| Static | 0.180 | 0.088 |
| Dynamic | 0.112 | 0.068 |
| Coefficient of friction with 60 kg loading: | | |
| Static | 0.192 | 0.040 |
| Dynamic | 0.122 | 0.082 |
| 4 Ball Wear Test according to ASTM procedure D-2266 Scar diameter (mm) | 0.40 | 0.33 |
| 4 Ball Extreme Pressure Test according to ASTM procedure D-2596: | | |
| Weld | 250 | 250 |
| Load wear index (kg) | 69 | 41 |
| Timken Test according to ASTM procedure D-2509 OK load (lbs) | 60 | 40 |
| Dropping Point according to ASTM procedure D-2265 Temperature (°F.) | 364 | 560 |

ASTM procedures D-2266, D-2596, D-2509 and D-2265 are well known procedures published by the American Society of Testing Materials and are hereby fully incorporated herein by reference.

The above coefficients of friction and stick-slip data are determined according to the LVFA method described above.

As mentioned above, the colloidal disperse systems useful in the present invention may be applied without any additional components, or may be formulated with a Newtonian overbased material such as any of the starting materials for making the non-Newtonia colloidal disperse systems described herein, an oil of lubricant viscosity, a grease, and/or additional functional additives as further described below.

Functional Additives:

The functional additives that can be dispersed with the compositions of this invention are generally well known to those of skill in the art as mineral oil and fuel additives. They generally are not soluble in water beyond the level of one gram per 100 millimeters at 25° C., and often are less soluble than that. Their mineral oil solubility is generally about at least one gram per liter at 25° C.

Among the functional additives are extreme pressure agents, corrosion and oxidation inhibiting agents, such as sulfurized organic compounds, particularly hydrocarbyl sulfides and polysulfides (such as alkyl and aryl sulfides and polysulfides including olefins, aldehydes and esters thereof, e.g., benzyl disulfide, benzyl trisulfide, dibutyltetrasulfide, sulfurized esters of fatty acid, sulfurized alkyl phenols, sulfurized dipentenes and sulfurized terpenes). Among these sulfurized organic compounds, the hydrocarbyl polysulfides are preferred.

The particular species of the sulfurized organic compound is not particularly critical to the present invention. However, it is preferred that the sulfur be incorporated in the organic compound as the sulfide moiety, i.e., in its divalent oxidation state and that it is oil-soluble. The sulfurized organic compound may be prepared by sulfurization of an aliphatic, arylaliphatic or alicyclic hydrocarbon. Olefinic hydrocarbons containing from about 3 to about 30 carbon atoms are preferred for the purposes of the present invention.

The olefinic hydrocarbons which may be sulfurized are diverse in nature. They contain at least one olefinic double bond, which is defined as a non-aromatic double bond; that is, one connecting two aliphatic carbon atoms. In its broadest sense, the olefinic hydrocarbon may be defined by the formula $R^7R^8C{=}CR^9R^{10}$, wherein each of $R^7$, $R^8$, $R^9$ and $R^{10}$ is hydrogen or a hydrocarbon (especially alkyl or alkenyl) radical. Any two of $R^7$, $R^8$, $R^9$ and $R^{10}$ may also together form an alkylene or substituted alkylene group; i.e., the olefinic compound may be alicyclic.

Monoolefinic and diolefinic compounds, particularly the former, are preferred in the preparation of the sulfurized organic compound, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3—3- and especially about 3-20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent used from the preparation of sulfurized organic compounds may be, for example, sulfur, a sulfur halide such as sulfur monochloride or sulfur dichloride, a mixture of hydrogen sulfide and sulfur or sulfur dioxide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3-3.0 gram-atoms and about 0.1-1.5 moles. The preferred ranges are about 0.5-2.0 gram-atoms and about 0.4-1.25 moles respectively, and the most desirable ranges are about 1.2-1.8 gram-atoms and about 0.4-0.8 mole respectively.

The temperature range in which the sulfurization reaction is carried out is generally about 50°-350° C. The preferred range is about 100°-200° C., with about 125°-180° C. being especially suitable. The reaction is often preferably conducted under elevated pressure; this may be and usually is autogenous pressure (i.e., the pressure which naturally develops during the course of the reaction), but may also be externally applied pressure. The exact pressure developed during the reaction is dependent upon such factors as the design and operation of the system, the reaction temperature, and the vapor pressure of the reactants and products and it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.05-2.0% of the weight of the olefinic compound. In the case of the preferred ammonia and amine catalysts, about 0.0005-0.5 mole per mole of olefin is preferred, and about 0.001-0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of sulfurized organic compound is the treatment of the sulfurized product, obtained as described hereinabove, to reduce active sulfur. An illustrative method is treatment with an alkali metal sulfide. Other optional treatments may be employed to remove insoluble byproducts and improve such qualities as the odor, color and staining characteristics of the sulfurized compositions.

U.S. Pat. No. 4,119,549 is incorporated by reference herein for its disclosure of suitable sulfurization products useful as auxiliary extreme pressure/anti-wear agents in the present invention. Several specific sulfurized compositions are described in the working examples thereof. The following examples illustrate the preparation of two such compositions.

EXAMPLE A

Sulfur (629 parts, 19.6 moles) is charged to a jacketed high-pressure reactor which is fitted with an agitator and internal cooling coils. Refrigerated brine is circulated through the coils to cool the reactor prior to the introduction of the gaseous reactants. After sealing the reactor, evacuating to about 6 torr and cooling, 1100 parts (19.6 moles) of isobutene, 334 parts (9.8 moles) of hydrogen sulfide and 7 parts of n-butylamine are charged to the reactor. The reactor is heated, using steam in the external jacket, to a temperature of about 171° C. over about 1.5 hours. A maximum pressure of 720 psig. is reached at about 138° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized product is recovered as a liquid.

EXAMPLE B

Following substantially the procedure of Example A, 773 parts of diisobutene is reacted with 428.6 parts of sulfur and 143.6 parts of hydrogen sulfide in the presence of 2.6 parts of n-butylamine, under autogenous pressure at a temperature of about 150°-155° C. Volatile materials are removed and the sulfurized product is recovered as a liquid.

The functional additive can also be chosen from phosphorus-containing materials and include phosphosulfurized hydrocarbons such as the reaction product of a phosphorus sulfide with terpenes, such as turpentine, or fatty esters, such as methyl oleate, phosphorus esters such as hydrocarbyl phosphites, particularly the acid dihydrocarbyl and trihydrocarbyl phosphites such as dibutyl phosphites, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene-substituted phenyl phosphite, diisobutyl-substituted phenyl phosphite; metal salts of acid phosphate and thiophosphate hydrocarbyl esters such as metal phosphorodithioates including zinc dicyclohexyl phosphorodithioate, zinc dioctylphosphorodithioate, barium di(heptylphenol)phosphorodithioate, cadmium dinonylphosphorodithioate, and the zinc salt of a phosphorodithioic acid products by the reaction of phosphorus pentasulfide with an equimolar mixture of isopropyl alcohol and n-hexyl alcohol.

Another type of suitable functional additives includes carbamates and their thioanalogs such as metal thiocarbamates and dithiocarbamates and their esters, such as zinc dioctyldithiocarbamate, and barium heptylphenyl dithiocarbamate.

Other types of suitable functional additives include overbased and gelled overbased carboxylic, sulfonic and phosphorus acid salts, high molecular weight carboxylate esters, and nitrogen-containing modifications thereof, high molecular weight phenols, condensates thereof; high molecular weight amines and polyamines; high molecular weight carboxylic acid/amino compound products, etc. Typically, these functional additives are antiwear, extreme pressure, and/or load-carrying agents, such as the well known metal salts of acid phosphates and acid thiophosphate hydrocarbyl esters. An example of the latter are the well known zinc di(alkyl) or di(aryl) dithiophosphates. Further descriptions of these and other suitable functional additives can be found in the aforementioned treatises "Lubricant Additives" which are hereby incorporated by reference for their disclosures in this regard.

The amount of the non-Newtonian colloidal disperse system combined with auxiliary extreme pressure agent for rail lubricant compositions of the present invention may vary over a wide range. For example, the weight ratio of non-Newtonian colloidal disperse system to auxiliary extreme pressure agent may range from about 1:1 to essentially no auxiliary extreme pressure agent at all. However, as a preferred range, the weight ratio of non-Newtonian colloidal disperse system to auxiliary extreme pressure agent is from about 10:1 to about 50:1, particularly when the non-Newtonian colloidal disperse system contains a metal ratio, as defined above, greater than 15.

In preferred embodiments of the railroad track lubricant compositions used in the present invention, a tackiness agent may also be present in an amount effective to aid in adhering the lubricant composition to railroad track and wheel flange. The tackiness agent may, for example, be a hydrocarbon resin, and may be present in an amount in the range from about 0.1% to 4% by weight of the lubricant composition, preferably in the range from about 0.5% to about 2% by weight.

Other additives which may optionally be present in the rail lubricant compositions for use in this invention include:

Antioxidants, typically hindered phenols and aromatic amines.

Corrosion, wear and rust inhibiting agents.

Friction modifying agents, of which the following are illustrative: alkyl or alkenyl phosphates or phosphites in which the alkyl or alkenyl group contains from about 10 to about 40 carbon atoms, and metal salts thereof, especially zinc salts; $C_{10-20}$ fatty acid amides; $C_{10-20}$ alkyl amines, especially tallow amines and ethoxylated derivatives thereof; salts of such amines with acids such as boric acid or phosphoric acid which have been partially esterified as noted above; $C_{10-20}$ alkyl-substituted imidazolines and similar nitrogen heterocycles.

A pour point depressant amount of a pour point depressant may also be incorporated into rail lubricant compositions of the present invention which have measurable pour point. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967), which is incorporated herein by reference.

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference.

The non-Newtonian colloidal disperse system and, optionally, one or more functional additives may be added separately or as a mixture to a base grease stock or base oil stock to obtain a grease or oil composition for use as a rail lubricant in the present invention, or may be combined separately or as a mixture with a Newtonian overbased material. The combination of non-Newtonian colloidal disperse system and functional additive may also be used neat (i.e., with essentially no other additives or components).

Grease compositions or base grease stocks are derived from both mineral and synthetic oils. The synthetic oils include polyolefin oils (e.g., polybutene oil, decene oligimer, and the like), synthetic esters (e.g., dinonyl sebacate, trioctanoic acid ester of trimethylolpropane, and the like), polyglycol oils, and the like. The grease composition is then made from these oils by adding a thickening agent such as a sodium, calcium, lithium, or aluminum salts of fatty acids such as stearic acid. To this base grease stock, then may be blended the above-described non-Newtonian colloidal disperse system as well as other known or conventional additives such as those described above. The grease composition of the present invention may contain from about 1 weight percent to about 99 weight percent of non-Newtonian colloidal disperse system and from 0.1 percent to about 5 weight percent of auxiliary extreme pressure agent of the additive of the present invention. As a preferred embodiment, the effective amount of non-Newtonian colloidal disperse system in the grease composition will range from about 5 weight percent to about 50 weight percent and the effective amount of auxiliary extreme pressure agent will range from about 0.5 weight percent to about 2 weight percent.

Suitable lubricating oils include natural and synthetic oils and mixtures thereof.

Natural oils are often preferred; they include liquid petroleum oils and solvent-treated or acid-treated mineral lubricating oils of the paraffinic, napthenic and mixed paraffinic-naphthenic types. Oils of lubricating viscosity derived from coal or shale are also useful base oils.

Synthetic lubricating oils include hydrocarbon oils and halosubstituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)]; alkylbenzenes [e.g., dodecylbenzenes, tetradecylbenzenes, dinonylbenzenes, di(2-ethylhexyl)benzenes]; polyphenyls (e.g., biphenyls, terphenyls, alkylated polyphenyls); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono-and polycarboxylic esters thereof, for example, the acetic acid esters, mixed C3-C8 fatty acid esters and C13 Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, sebacic acid, fumaric acid, adipic acid, linoleic acid dimer, malonic acid, alkyl malonic acids, alkenyl malonic acids) with a variety of alcohols (e.g., butyl alcohol, hexyl alcohol, dodecyl alcohol, 2-ethylhexyl alcohol, ethylene glycol, diethylene glycol monoethylether, propylene glycol). Specific examples of these esters include dibutyl adipate, di(2-ethylhexyl) sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethyl-hexanoic acid.

Esters useful as synthetic oils also include those made from $C_5$ to $C_{12}$ monocarboxylic acids and polyols and polyol ethers such as neopentyl glycol, trimethylolpropane, pentraerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used as component A according to the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The metal overbased salt of an acidic organic compound is preferably a basic alkaline earth metal salt of at least one acidic organic compound. This component is among those art-recognized metal-containing compositions variously referred to by such names as "basic", "superbased" and "overbased" salts or complexes. The method for their preparation is commonly referred to as "overbasing". The term "metal ratio" is often used to define the quantity of metal in these salts or complexes relative to the quantity or organic anion, and is defined as the ratio of the number of equivalents of metal to the number of equivalents thereof which would be present in a normal salt based upon the usual stoichiometry of the compounds involved.

The alkaline earth metals present in the basic alkaline earth metal salts include principally calcium, magnesium, barium and strontium, with calcium being preferred because of its availability and relatively low cost.

The non-Newtonian colloidal disperse systems made from metal overbased carboxylates, especially the metal overbased unsaturated linear hydrocarbon fatty acids such as the calcium overbased tall oil fatty acids, are preferred because of some surprising rail lubrication advantages, namely greater friction reduction without additive supplements, as measured with ASTM procedure D-2266 (4 Ball Test), high dropping point, which reduces the number of times the material must be reapplied to the rail, and freedom from the environmental, toxicological, and cleanliness problems.

One reason why the rail lubricant compositions made from non-Newtonian colloidal disperse systems of metal overbased carboxylates have few, if any, environmental, toxicological, or cleanliness problems is because these rail lubricants in particular do not require the presence of auxiliary friction-modifying and auxiliary extreme-pressure/anti-wear agents, which are generally a significant source of environmental, toxicological and/or cleanliness problems.

For the above reasons, the present invention includes rail lubricating compositions which are environmentally safe to use and conducive to ease of railroad applicator use. In particular, rail lubricating compositions comprising the above-mentioned unsaturated linear hydrocarbon carboxylates having from about 8 to about 30 carbon atoms wherein at least 80 percent of the metal-containing colloidal particles in the colloidal disperse system have a particle size of less than about 5.0 microns are preferred, and 80 percent of the particles having a particle size less than about 2.0 microns is more preferred.

It is preferred that components which have toxic, environmental or cleanliness problems, such as heavy metals, halogenated organic compounds, transition metals such as molybdenum, graphite, extreme pressure/anti-wear agents, etc., be excluded from the composition.

Components which would increase the water solubility of the rail lubricant compositions of the present invention, such as solubilizers and/or surfactants, are preferably excluded, since it is an objective of the present invention to obtain long lasting rail lubrication which would not be easily washed off by the rain, for example.

A specific example of the application of a formulation containing the above-described colloidal disperse system in accordance with the present invention follows.

EXAMPLE 8

A formulation is prepared by mixing 94 parts of the colloidal disperse system made according to Example 4 above with 5 parts of the sulfurized product produced according to above Example B, and 1 part of Tackifier 633 TM (a commercially available tackifier from Huls Canada, Inc.).

The formulation of Example 8 is loaded into a mechanical rail lubricant applicator of the type used by railroads. For evaluation of the performance of the formulation, two 25 gram samples (plus or minus a few grams) are applied to the gage face of the high rail at the initial part of a 5 degree reverse curve. Vis-a-vis an instrumented axle on a test train, it is possible to measure longitudinal wheel force which correlates with retentivity and spreadability performance. A portable tribometer may be used to monitor the top of rail contamination and flowability.

The test data shows that the formulation has the desired longitudinal wheel force reduction, retentivity, and spreadability of a rail lubricant with the desired levels of top of rail contamination and flowability.

Another aspect of the present invention is a rail lubricating system comprising a rail lubricant applicator containing a lubricant composition, wherein the lubricant composition comprises the overbased non-Newtonian colloidal disperse systems described above for use in the method of the present invention. Lubricant applicators include the types generally known in the art, such as wayside rail lubricant applicators, hyrail type applicators, and applicators to be mounted on a railroad locomotive. These applicators have in common a means for holding or containing the rail lubricant composition and a means for applying the rail lubricant held in the applicator to the gage face of a railroad rail or to the surface of a flange of a railroad wheel engaging the gage face of a railroad wheel whereby the lubricant is transferred to some extent to the gage face of the rail as the railroad wheel rolls on the rail. These rail lubricant applicators are well known to those of ordinary skill in the art and are commercially available. Well known rail lubricant applicators are the Wiley Vogel, Fuji Flange Lubricator, TSM and Unit Rail railroad locomotive mounted applicators, the Madison-Kipp Hyrail applicator, and the Madison-Kipp, Moore & Steele, and Portec wayside lubricators. These lubricators are in commercial use by railroad companies such as Conrail, Norfolk Southern, CSX, Santa Fe, Burlington Northern, Canadian National RR, Canadian Pacific RR, and others.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A method for reducing friction between railroad wheel and tangent track, railway wheel replacement and tangent track replacement comprising applying to the tangent railway track a composition comprising an overbased non-Newtonian colloidal disperse system comprising (1) solid metal-containing colloidal particles predispersed in (2) a disperse medium of at least one inert organic liquid and (3) at least one member selected from the class consisting of organic compounds which are substantially soluble in the disperse medium, wherein the molecules of said organic compound have polar substituents and hydrophobic portions, provided further that the solid metal-containing colloidal particles of said system have an average unit particle size up to about 5.0 microns.

2. The method of claim 1, wherein the solid metal-containing colloidal particles of said system are formed in situ in said disperse system from metal-containing materials homogeneously dispersed in a single phase Newtonial overbased material having a metal ratio of at least 1.1.

3. The method of claim 1 wherein the solid metal-containing collodial particles of said system have a number average unit particle size up to about 2.0 microns and wherein more than 80 number percent of the solid metal-containing particles of said system have a unit particle size less than 5.0 microns.

4. The method of claim 3 wherein the solid metal-containing colloidal particles of said system are formed in situ in said disperse system from metal-containing materials homogeneously dispersed in a single phase Newtonian overbased material having a metal ratio of at least 1.1.

5. The method of claim 1 wherein the solid metal-containing colloidal particles of said system have a number average unit particle size up to about 1.0 micron and wherein more than 80 number percent of the solid metal-containing particles of said system have a unit particle size less than 2.0 microns.

6. The method of claim 1 wherein the solid metal-containing colloidal particles comprise alkali metal salts.

7. The method of claim 6 wherein the alkali metal salt is selected from the group consisting of sodium and lithium.

8. The method of claim 1 wherein the solid metal-containing colloidal particles comprise at least one alkaline earth metal salt.

9. The method of claim 8 wherein the alkaline earth metal salt is selected from the group consisting of calcium, magnesium, and barium salts and mixtures thereof.

10. The method of claim 8 wherein the solid metal-containing colloidal particles consist essentially of at least one alkaline earth metal salt.

11. The method of claim 10 wherein the alkaline earth metal salt comprises a calcium salt.

12. The method of claim 1 wherein the solid metal-containing colloidal particles are selected from the group consisting of alkaline earth metal acetates, formates, carbonates, sulfides, sulfites, sulfates, thiosulfates, and halides.

13. The method of claim 12 wherein said solid metal-containing colloidal particles are selected from the group consisting of calcium, sodium, lithium, and barium carbonates and calcium, sodium, lithium, and barium acetates.

14. The method of claim 1 wherein the disperse medium comprises mineral oil and at least one other organic liquid miscible with mineral oil.

15. The method of claim 1 wherein (3) comprises at least one alkaline earth metal salt of a petrosulfonic acid, a mono-, di-, and trialiphatic hydrocarbon substituted aryl sulfonic acid, and a carboxylic acid.

16. The method of claim 15 wherein the carboxylic acid comprises at least one linear unsaturated hydrocarbon group containing from about 12 to about 22 carbon atoms.

17. The method of claim 1 wherein (3) comprises an alkaline earth metal salt of a carboxylic acid.

18. The method of claim 1 wherein (3) comprises at least one alkali or alkaline earth metal salt of a carboxylic acid comprising at least one linear unsaturated hydrocarbon group containing from about 8 to about 30 carbon atoms.

19. The method of claim 18 wherein the carboxylic acid comprises at least one linear unsaturated hydrocarbon group containing from about 16 to about 20 carbon atoms.

20. The method of claim 18 wherein the carboxylic acid comprises at least one carboxyl group substituted on a terminal carbon atom of the unsaturated hydrocarbon group.

21. The method of claim 18 wherein the carboxylic acid comprises a monocarboxylic acid.

22. The method of claim 18 wherein the carboxylic acid is selected from the group consisting of tall oil fatty acids, linoleic acid, abietic acid, linolenic acid, palmitoleic acid, oleic acid, and ricinoleic acid.

23. The method of claim 18 wherein the solid metal-containing colloidal particles are selected from the group consisting of alkali and alkaline earth metal carbonates and bicarbonates, or mixtures thereof, which are present in an amount of from about 4.0 equivalents to about 40 equivalents of alkali metal or alkaline earth metal in the colloidal particles per equivalent of carboxylic acid present in (3).

24. The method of claim 1 wherein the composition comprising an overbased non-Newtonian colloidal disperse system further comprises a single-phase homogeneous Newtonian overbased material.

25. The method of claim 24 wherein the single-phase homogeneous Newtonian overbased material has a metal ratio of at least 4.0.

26. The method of claim 24 wherein the single-phase homogeneous Newtonian overbased material comprises an alkali or alkaline earth metal salt of a carboxylic acid.

27. The method of claim 24 wherein the single-phase homogeneous Newtonian overbased material comprises at least one alkali or alkaline earth metal salt of a carboxylic acid comprising at least one linear unsaturated hydrocarbon group containing from about 8 to about 30 carbon atoms.

28. The method of claim 27 wherein the carboxylic acid comprises a monocarboxylic acid.

29. The method of claim 27 wherein the carboxylic acid is selected from the group consisting of tall oil fatty acids, linoleic acid, abietic acid, linolenic acid, palmitoleic acid, oleic acid, and ricinoleic acid.

30. The method of claim 1 wherein the composition comprising the overbased material further comprises an auxiliary extreme pressure agent.

31. The method of claim 30 wherein the extreme pressure agent is selected from the group consisting of hydrocarbyl sulfides and polysulfides, sulfurized fatty esters, phosphosulfurized hydrocarbons, phosphorus esters, metal dithiocarbamates, metal dithiocarbamate esters, metal phosphorodithioates, and mixtures thereof.

32. The method of claim 30 wherein the extreme pressure agent comprises a hydrocarbyl polysulfide.

33. The method of claim 30 wherein the extreme pressure agent comprises the reaction product of a phosphorus sulfide with turpentine or methyl oleate, and mixtures thereof.

34. The method of claim 30 wherein the extreme pressure agent comprises a hydrocarbyl phosphite.

35. The method of claim 30 wherein the extreme pressure agent comprises the reaction product of sulfurization of at least one fatty acid and at least one α-olefin.

36. The method of claim 30 wherein the extreme pressure agent comprises the reaction product of sulfurization of a mixture of soybean oil, $C_{15-18}$ α-olefin, and tall oil fatty acids.

37. The method of claim 30 wherein the extreme pressure agent comprises a metal dithiocarbamate and esters thereof.

* * * * *